US005553753A

United States Patent [19]

Abplanalp

[11] Patent Number: 5,553,753

[45] Date of Patent: Sep. 10, 1996

[54] METHOD OF MANUFACTURING A PLASTIC AEROSOL CONTAINER HAVING PLASTIC END CLOSURES

[76] Inventor: Robert H. Abplanalp, 10 Hewitt Ave., Bronxville, N.Y. 10708

[21] Appl. No.: 450,395

[22] Filed: May 25, 1995

Related U.S. Application Data

[63] Continuation of Ser. No. 298,371, Aug. 30, 1994, abandoned, which is a continuation of Ser. No. 68,602, May 27, 1993, abandoned, which is a continuation of Ser. No. 937,439, Aug. 27, 1992, abandoned, which is a continuation of Ser. No. 837,653, Feb. 14, 1992, abandoned, which is a continuation of Ser. No. 730,567, Jul. 15, 1991, abandoned, which is a continuation of Ser. No. 634,927, Dec. 26, 1990, abandoned, which is a continuation of Ser. No. 517,553, Apr. 24, 1990, abandoned, which is a continuation of Ser. No. 406,879, Sep. 13, 1989, abandoned, which is a continuation of Ser. No. 296,407, Jan. 9, 1989, abandoned, which is a continuation of Ser. No. 136,553, Dec. 22, 1987, abandoned.

[51] Int. Cl.[6] ..... B67D 5/42

[52] U.S. Cl. ..... 222/387; 220/4.05

[58] Field of Search ..... 220/67, 76, 66, 220/88, 4.05, 319, 613; 156/69, 273.9; 222/387, 389

[56] References Cited

U.S. PATENT DOCUMENTS

| | | | |
|---|---|---|---|
| 3,095,112 | 6/1963 | Weinstein et al. | 220/67 |
| 3,108,710 | 10/1963 | Lange et al | 220/76 |
| 3,313,440 | 4/1967 | Nofev | 222/67 |
| 3,406,891 | 10/1968 | Buchner et al. | 220/67 |
| 4,201,306 | 5/1980 | Dubois et al. | 220/5 R |
| 4,508,244 | 4/1985 | Plaschka et al. | 222/153 |

*Primary Examiner*—Kenneth Noland
*Attorney, Agent, or Firm*—Kilgannon & Steidl

[57] ABSTRACT

Broadly stated, this invention comprises a pressure container having an extruded plastic body portion and plastic end closures for the body portion, each end closure having a recess portion for receiving the respective ends of the body portion. In a preferred embodiment one of the closures is adapted to receive a conventional aerosol valve having a mounting cup for clinching onto the said closure. In a still further preferred embodiment, the non-valved closure has a port for bottom gassing of the container when the product to be discharged and the propellant are separated by a piston.

23 Claims, 3 Drawing Sheets

METHOD OF MANUFACTURING A PLASTIC AEROSOL CONTAINER HAVING PLASTIC END CLOSURES

This is a continuation of application Ser. No. 08/298,371 filed on Aug. 30, 1994, now abandoned; which is a continuation of U.S. Ser. No. 08/068,602 filed on May 27, 1993, now abandoned, which is a continuation of U.S. Ser. No. 07/937,439 filed on Aug. 27, 1992, now abandoned; which is a continuation of U.S. Ser. No. 07/837,653 filed Feb. 14, 1992, now abandoned; which is a continuation of U.S. Ser. No. 07/730,567 filed Jul. 15, 1991, now abandoned; which is a continuation of U.S. Ser. No. 07/634,927 filed Dec. 26, 1990, now abandoned; which is a continuation of U.S. Ser. No. 07/517,553 filed Apr. 24, 1990, now abandoned; which is a continuation of U.S. Ser. No. 07/406,879 filed Sep. 13, 1989, now abandoned; which is a continuation of U.S. Ser. No. 07/296,407 filed Jan. 9, 1989, now abandoned; which is a continuation of U.S. Ser. No. 07/136,553 filed Dec. 22, 1987, now abandoned.

This invention relates to a method of manufacturing a plastic pressure container having a seamless extruded plastic body portion and plastic end closures. In one embodiment of the pressure container, one of said closures is adapted for receiving a manually operated valve unit. The body portion is formed by an extrusion process and the closures by injection or other molding processes.

BACKGROUND

Pressure containers have in the past been largely constructed of a metal body and metal end closures. In the instance of the pressure container being an aerosol container, one end closure is contoured to receive and have crimped thereto a metal component referred to in the art as a mounting cup, which cup has affixed thereto a manually-actuable valve.

The metal body of the container is seamed along its length in the case of steel containers. This results, though avoidance is attempted, in an inner shape that is not truly cylindrical, the seam providing a discontinuity in the "true round" shape. In the case of aerosol aluminum containers, though seamless, the thin wall of the container is readily dented and a deviation from the "true round" results.

For many applications of an aerosol package system, for example, where a piston traversing the inner wall of the container body is a component of the package, a deviation from "true round" is undesirable. Where there is deviation from the "true round" a breakage in the seal between the inner wall of the container and the piston will occur with a concomitant loss or decrease in the efficiency of the discharge of the contents of the pressurized container.

Additional shortcomings of metal containers, often manufactured away from the site where the product is introduced into the container, is the shipment of the container to the filling site. Moreover, corrosion may be a problem necessitating a coating of the metal in order to make the inner surface of the container compatible with the product to be dispensed, and consequently and additional manufacturing operation.

The deficiencies of metal containers have resulted in an effort by marketers to replace the metal container with a plastic container.

Plastic pressure container have to date been manufactured by injection molding or blow molding processes. Both processes have serious drawbacks.

When injection molding a container, it is necessary that the body portion of the container have a draft or slope in order to eject the container from the mold. Further, and particularly with containers having a body portion with a length of conventional containers, such as beverage or aerosol containers, it is extremely difficult to fill the cavity defining the body portion of the container with the consequence that channeling or incomplete fill of the injection mold cavity results. As a consequence, in order to properly fill the cavity it is essential to use excessive temperature and pressure conditions, which result in a differential temperature profile over the length of the cavity and consequently stress and strain, warping and embrittlement of the molded container. Additionally, it is difficult to hold the core defining the inside wall of the body portion of the container properly centered with the result that the container wall is of varying thickness. Since permeation from within or external to the container is a function, among others, of the wall thickness, to compensate for a shift from true center of the cavity core, the injection mold cavity must be designed to provide a minimum wall thickness throughout. To assure the necessary minimum thickness necessarily results in a design of a wall thickness excessive to that necessary to properly contain the product.

Blow molding, necessarily, results in the wall of the pressure container being of uneven thickness since the pressure and temperature variations on the surface of the parison or preform is not uniform. Moreover, molecular weight variation in the parison and pre-form foreclose formation of a container having a substantially uniform wall thickness. Thus, as in an injection molding process, excessive amounts of plastic must be used in order to assure the minimum wall thickness necessary throughout the container to properly contain the product to be dispensed. Obviously, a variation in the wall thickness precludes formation of a body portion having an inner surface that is "true round" and consequently the container lacks usefulness as a container where the "true round" is essential to the dispensing of the product.

Further, in blow molding a container the end closures necessarily must be formed of the same plastic material. Further, in blow molding design, flexibility is limited. Moreover, in an aerosol-type container, where the top opening is smaller in diameter than the body portion of the container it is impossible to position a piston having a diameter substantially the same as the inside diameter of the container with the container.

SUMMARY OF THE INVENTION

Broadly stated, this invention comprises a pressure container having an extruded plastic body portion and plastic end closures for the body portion, each end closure having a recess portion for receiving the respective ends of the body portion. In a preferred embodiment one of the closures is adapted to receive a conventional aerosol valve having a mounting cup for clinching onto the said closure. In a still further preferred embodiment, the non-valved closure has a port for bottom gassing of the container when the product to be discharged and the propellant are separated by a piston.

The present invention will be more clearly understood by referring to the drawings herein and the discussion relating thereto.

IN THE DRAWINGS

DESCRIPTION OF THE INVENTION

Figure 1:
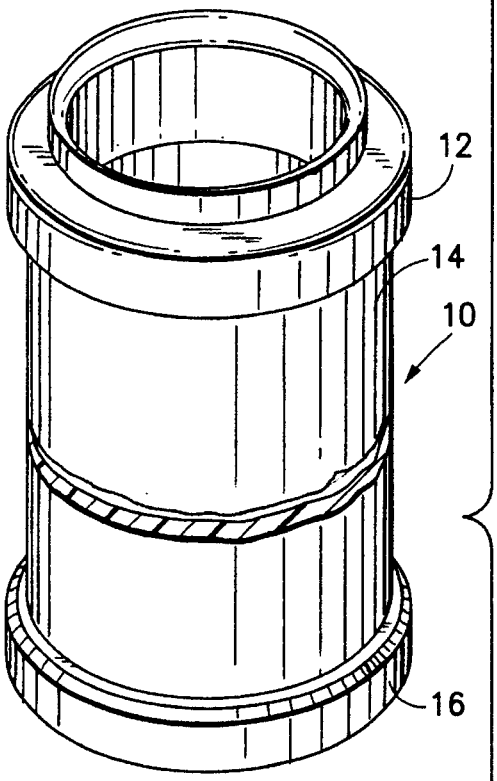
FIG. 1 is a perspective view of the plastic container of this invention with a section through the body portion.

In FIG. 1, the container generally designated as 10, has a valve receiving end closure 12, a cylindrical body portion 14, and an end closure 16.

Figure 2:
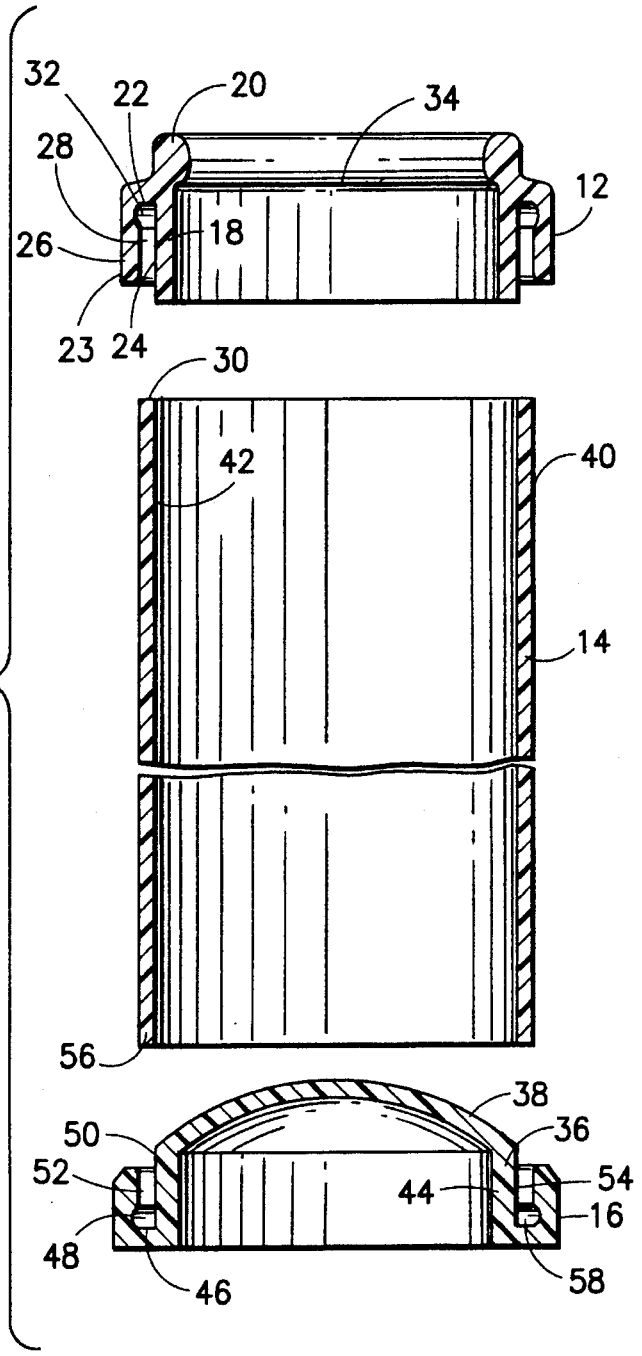
FIG. 2 is an exploded cross-section of the body portion and the valve receiving and bottom end closures of the plastic container of this invention.

As shown in FIG. 2, the body portion 14 is seamless and in the form shown, cylindrical. The body portion should be able to withstand pressures within the container normally attendant to pressurized containers, such as, for example aerosol dispensers.

The body portion 14 is extrusion formed. It has been found that a group of polyethylene terephthalate resins, referred to as barrier resins and marketed under trademarks, such as Selar® PT resins (marketed by E.I. du Pont de Nemours) are suitable materials for the body portion. Specific Selar® PT resins found suitable are Selar® PT and Selar® PT 5270. Another barrier resin, useful in forming translucent body portions are Selar® PA 3426, this resin being an amorphous nylon. It has been found that with the aforementioned Selar® resins, a container having a wall thickness of 0.010–"0.060" is satisfactory to function as the container body under normal aerosol dispenser pressures of 10 to 150 PSI.

Conventional extrusion equipment, not shown, may be used to form the body portion 14. Conventional injection molding equipment, not shown, may be used to form the end closures 12 and 16.

The valve receiving end closure 12 has an annular wall 18 having a bead portion 20 defining an opening 34 for receiving a conventional aerosol valve (not shown) and a shoulder portion 22 having an extending portion 23, the outer surface 24 of the annular wall 18 and the inner surface 26 of the extending portion 22 forming a recess 28 to receive the end portion 30 of the body portion 14. In the base of the recess 28 is an annular undercut 32.

When the end 30 is positioned in the recess 28, the components are spin welded by conventional techniques, the end portion 30 of the body 14 melting and flowing into the undercut 32 to thereby effect a fluid tight seal between the body portion 14 and the end closure 12.

A fluid tight seal between the walls defining the recess 28 and the outer 40 and inner 42 walls of the body portion 14 may also be accomplished through sonic welding of the contiguous surfaces of the recess 28 and the walls 40 and 42 of the body portion 14.

The end closure 16 has an annular upstanding wall 36, traversing which is the domed portion 38. As in end closure 12, closure 16 has an annular upstanding wall 44 and a shoulder 46 having an extending portion 48, the outer surface 50 of the annular wall 44 and the inner surface 52 of the extending portion 48 forming a recess 54 to receive the end portion 56 of the body portion 14. In the base of the recess 54 is an annular undercut 58.

The end closure 16 and the body portion 14 may be joined to form a fluid tight seal in the manner discussed aforesaid in reference to the end closure 12.

Figure 6:
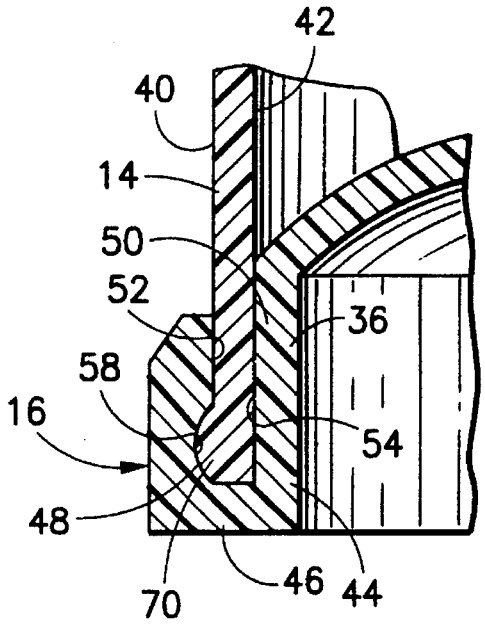
FIG. 6 is a vertical cross-section of a specific embodiment of an end closure of this invention.

An annular bead 70, shown in FIG. 6, may be formed in the undercuts 32 and 58 of the end closures 12 and 16 by melting the end portions of the body portion 14 and effecting a flow of the plastic body portion into the respective undercuts. The bead 70 effects a mechanical joinder between the end closures and the body portion of the container.

The undercuts 32 and 58 in the respective end closures 12 and 16 may be formed, alternatively, in the outside wall of the annular walls 18 and 50 of the end closures 12 and 16, respectively. Moreover, the recesses 28 and 54 of the end closures 12 and 16 may have disposed therein a heat conductive material, such as, metal which will act as a heat sink to transfer heat to the contiguous plastic components and effect a more rapid softening or melting of said contiguous plastic components and consequent formation of the bead 70.

Figure 7:
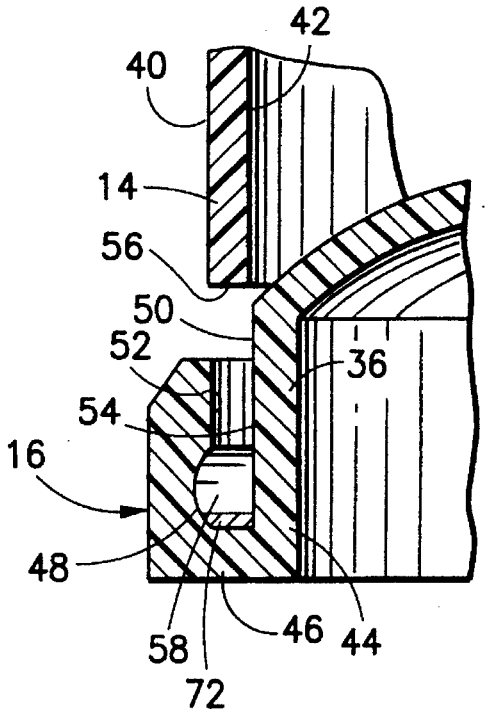
FIG. 7 is a vertical cross-section of a further embodiment of an end closure of this invention.

Additionally, a magnetic material may be disposed within the recess 54 (shown in FIG. 7 as 72), which material may function to magnetically affix the aerosol container beneath the surface of a normally floatating medium; for example, beneath the water surface in a water bath testing apparatus.

Moreover, an adhesive material having a melting point below that of the body portion and end closures may be disposed in the respective recesses of the end closures or on the terminal portions of the end closures, which adhesive will melt and flow into the undercuts to form an annular bead, thus effecting a mechanical bonding between the closure and the body portion. Additionally, the adhesive material may contain a magnetic material to serve the function set forth above for said material.

Figure 3:
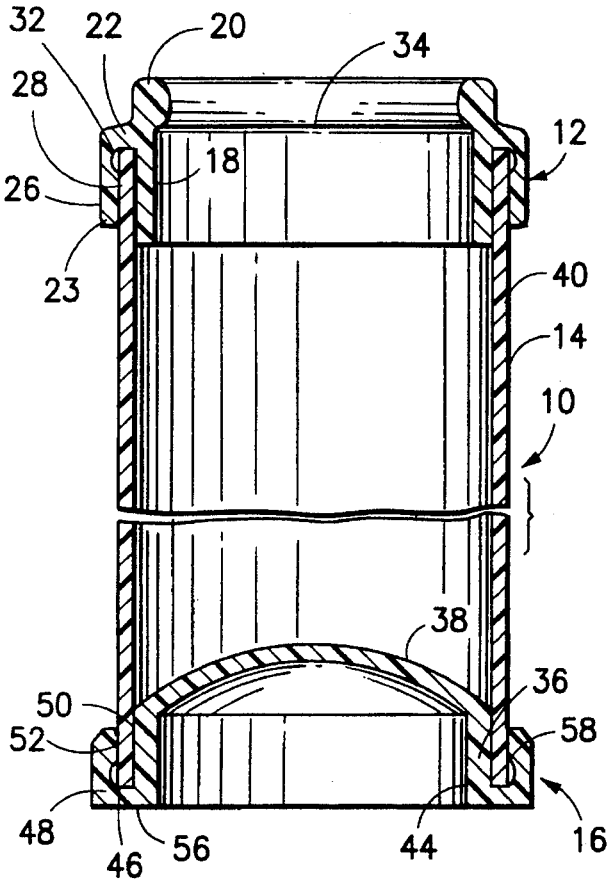
FIG. 3 is a vertical cross-section of the plastic container of this invention.
Figure 5:
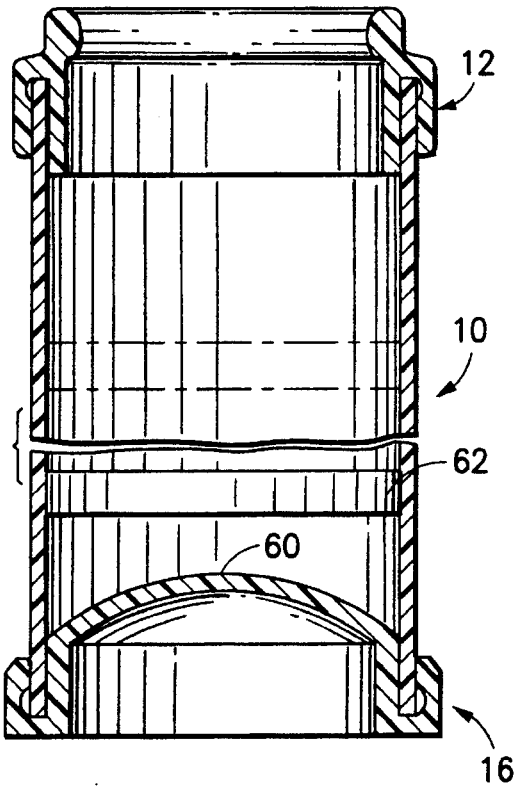
FIG. 5 is a vertical cross-section of a further embodiment of the invention.

Shown in FIG. 5 is a plastic container assemblage, wherein, in addition to the structure shown in FIG. 3 there is a port 60 and a piston 62 (shown in dotted line as it moves toward the valved end of the container during evacuation of the container contents).

The end closures may be injection molded. It has been found that polyacetal polymers form satisfactory injection molded end closures.

Figure 4:
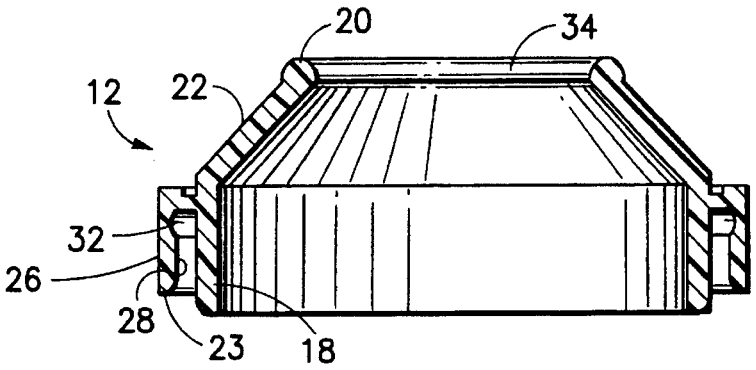
FIG. 4 is a vertical cross-section of the valve receiving end closure of this invention.

The end closure may be constructed to accommodate varying body portion diameters. As shown in FIG. 4, the bead portion 20 of the valve end closure 12 to which the valve is crimped may be constructed to maintain a standard valve opening by inwardly and upwardly projecting an annular wall 22 from the wall 18 which terminates in the bead 20.

While the invention has been illustrated showing a body portion 14 of cylindrical design, it should be understood that the shape of the body portion is not so limited; the body portion 14 being limited to exclude only shapes incapable of being extrusion formed. Thus, for example, the body portion may be rectangular, triangular, oval, hexagonal, etc. Moreover, the body portion 14 may be formed by coextruding different plastic materials to tailor permeability and other physical properties of the body portion 14.

As with a cylindrically shaped body portion, the inner surface of the extruded body portion is dimensionally uniform throughout the length of the body portion. Consequently, the body portion may more efficaciously function as a container body having a piston traversing its length.

With the subject invention plastic pressure containers may be manufactured which obviate the deficiencies enumerated above that are associated with injection and blow molding processes. Uniform wall thickness and a substantially uniform inner diameter through the entire length of the body portion of the container is readily attainable. Moreover by extrusion forming the body portion and injection molding, for example, of the end closures, a plastic container having end closures of a material dissimilar to the body portion of the container may be readily fabricated. By being able to form the end closures of a material different than the body portion, enables the containe manufacturer to utilize plastic materials in the end closure having the necessary strength characteristics to affix an aerosol valve to the end closure.

Additionally the standard concave shaping of the bottom of the conventional aerosol container is attainable to allow for an undue bulging. When blow-molding a plastic pressure container, the container design must have a spherical shape at the base of the container in order to withstand the pressure.

What is claimed:

1. A method for manufacturing a container (10) suitable for dispensing pressurized products and comprising an extruded seamless plastic body portion (14) capable of withstanding pressures associated with the product to be dispensed, the body portion have protuberances (70) at each end, and plastic end closure members (12, 16) each having an annular recess (28, 54) with an undercut (32, 58) for receiving the respective end (30, 56) and protuberance (70) of the body portion (14) and thereby forming a fluid tight seal between the body portion (14) and the end closure members (12, 16), characterized in that the protuberances (70) on the ends (30, 56) of the tubular body portion (14) are formed in situ in said recesses (28, 54) by heating said ends to flow the plastics of the tubular body portion (14) into said undercuts (32, 58).

2. The method according to claim 1, wherein the body portion is cylindrical, rectangular, triangular or hexagonal in cross-section.

3. The method according to claim 1 or 2, wherein the undercuts (32, 58) are located at the base of the annular recesses (28, 54) in the end closure members (12, 16).

4. The method according to any one of claims 1 to 2, wherein the container is intended for use as a plastics aerosol container and one end closure member (12) has a beaded (20) opening therein to receive a valve mounting cup.

5. The method according to claim 4, wherein the other end closure member (16) provides an inwardly domed-end cap (38) at the base of the aerosol container.

6. The method according to claim 5, wherein the inwardly domed-end closure member has an air vent or aperture (60) therein, and wherein a piston (62) is slidably mounted in the tubular body portion (14) of the container, a fluid tight seal being provided between the piston and the body portion of the container.

7. A container according to claim 3, wherein the undercuts are formed in the outer wall defining the recesses around the end closure members.

8. A container according to claim 3, wherein the beads on the ends of the tubular material are formed in situ in said recesses by heating said ends to flow the plastics of the tubular body portion into said undercuts.

9. A container according to claim 3, wherein the end closure members are secured, or additionally secured, on the ends of the tubular body portion by an adhesive located in said recesses.

10. A container according to claim 3, comprising a sink of heat conductive material located in the recesses of the end closure members.

11. A container according to claim 3, wherein an annulus of magnetic material is located in the annular recess in at least one of the two end closure members.

12. A container according to claim 11, wherein said heat conductive material and said magnetic material are provided by one and the same insert in said recess.

13. A container according the claim 11, wherein said magnetic material is incorporated in an adhesive located in the recesses in the ends to be attached to the tubular bodies.

14. A container according to claim 1, wherein the tubular body portion is of amorphous nylon or polyethylene terephthalate.

15. A container according to claim 1, wherein the end closure members are of injection molded polyacetal.

16. A container according to claim 14, wherein the end closure members are of injection molded polyacetal.

17. A container according to claim 1, intended for use as a plastics aerosol container, wherein one end closure has a beaded opening therein to receive a valve mounting cup.

18. A container according to claim 17, wherein the other end closure provides an inwardly domed end cup at the base of the aerosol container.

19. A plastic aerosol container suitable for dispensing pressurized products comprising an extruded seamless plastic body portion capable of withstanding pressures associated with the product to be dispensed without distortion, a first plastic end closure adapted to receive a conventional aerosol valve having a mounting cup for clinching onto the first plastic end closure and a second concave end closure capable of withstanding the pressure within the aerosol container, each of said plastic end closures having a recess for receiving the respective ends of the body portion and further having an undercut at the base of at least one sidewall of the recess, the ends of the plastic body portion within the respective recesses and the respective end closures being sealingly joined through melting of the body portion contiguous to the undercut to form a bead in the respective undercuts of the end closures.

20. The plastic aerosol container of claim 19, and further wherein the seamless plastic body portion dehors the recesses of the end closures has an inner surface that is cylindrical.

21. The plastic container of claim 19, and further wherein a piston is disposed within the container which is in slidable sealing relationship to the interior wall of the body portion.

22. The plastic container of claim 20, and further wherein a piston is disposed within the container which is in slidable sealing relationship to the interior wall of the body portion.

23. The plastic container of claims 21 or 22, and further having a port in the concave end closure which permits introduction of propellant into the container on the surface of the piston distal to the aerosol valve.

* * * * *